US006073687A

United States Patent [19]

Jensen et al.

[11] Patent Number: 6,073,687

[45] Date of Patent: Jun. 13, 2000

[54] HEAT EXCHANGE PLATE HAVING A REINFORCED EDGE STRUCTURE

[75] Inventors: Benny Jensen; Ellgård Søe Pedersen, both of Kolding; Jes Hansen Petersen, Lunderskov, all of Denmark

[73] Assignee: APV Heat Exchanger A/S, Kolding, Denmark

[21] Appl. No.: 09/228,695

[22] Filed: Jan. 12, 1999

[30] Foreign Application Priority Data

Jan. 12, 1998 [DK] Denmark ..... 1998 00027

[51] Int. Cl.[7] ..... F28F 3/08

[52] U.S. Cl. ..... 165/167; 165/166

[58] Field of Search ..... 165/166, 167

[56] References Cited

U.S. PATENT DOCUMENTS

| | | | |
|---|---|---|---|
| 3,661,203 | 5/1972 | Mesher | 165/167 |
| 3,792,730 | 2/1974 | Andersson | 165/167 |
| 4,284,135 | 8/1981 | Almqvist et al. | 165/166 |
| 4,635,714 | 1/1987 | Almqvist et al. | 165/167 |
| 4,911,235 | 3/1990 | Andersson et al. | 165/167 |
| 4,966,227 | 10/1990 | Andersson | 165/167 |
| 4,987,955 | 1/1991 | Bergqvist et al. | 165/167 |
| 5,178,212 | 1/1993 | Nakamura | 165/166 |
| 5,193,612 | 3/1993 | Strinkorb | 165/167 |
| 5,327,958 | 7/1994 | Machata et al. | 165/167 |
| 5,467,817 | 11/1995 | Schwald | 165/167 |
| 5,620,046 | 4/1997 | Waldhelm et al. | 165/153 |
| 5,638,899 | 6/1997 | Blomgren et al. | 165/166 |
| 5,887,650 | 3/1999 | Yang | 165/166 |

FOREIGN PATENT DOCUMENTS

| | | | |
|---|---|---|---|
| 50-22503 | 7/1975 | Japan | 165/167 |
| 8-271180 | 10/1996 | Japan . | |
| 165 960 | 2/1954 | Sweden . | |
| 7809204 | 8/1978 | Sweden . | |
| 1758388-A1 | 8/1992 | U.S.S.R. . | |
| 1035170 | 9/1964 | United Kingdom . | |
| 1264374 | 6/1969 | United Kingdom . | |
| 2164439 | 3/1986 | United Kingdom | 165/167 |
| 2204392 | 11/1988 | United Kingdom | 165/167 |
| WO 93/01463 | 1/1993 | WIPO . | |
| WO 95/00810 | 1/1995 | WIPO . | |

*Primary Examiner*—Ira S. Lazarus
*Assistant Examiner*—Terrell McKinnon
*Attorney, Agent, or Firm*—Leydig, Voit & Mayer, Ltd.

[57] ABSTRACT

A heat exchanger plate for use in a plate heat exchanger is made of a plate material which is pressed such that a gasket groove is formed, the gasket groove essentially extending along the edge of the heat exchanger plate. The plate material between the gasket groove and the edge of the heat exchanger plate is corrugated. The outermost portion of the heat exchanger plate is shaped as a plane face at least in an area along the edge of the heat exchanger plate, and the plane face is essentially positioned in the central plane of the pressed heat exchanger plate.

15 Claims, 2 Drawing Sheets

HEAT EXCHANGE PLATE HAVING A REINFORCED EDGE STRUCTURE

TECHNICAL FIELD

The invention relates generally to plate heat exchangers and more particularly to a heat exchange plate having a reinforced edge structure.

BACKGROUND OF THE INVENTION

One well-known type of heat exchanger is a plate heat exchanger. A plate heat exchanger is constructed using a series of plates in which each plate has two inlet holes, two outlet holes, and a series of channels. The channels allow a fluid to flow from one of the inlet holes to one of the outlet holes. The remaining inlet and outlet holes of each plate are sealed off from the channels by a gasket. By arranging several plates on top of one another in an alternating configuration, two intertwined fluid paths are created. Examples of such plates are depicted in FIGS. 1–3 of WIPO International Publication No. WO 93/01463, which is incorporated herein by reference in its entirety.

Rectangular heat exchanger plates are typically provided with a notch on each of the two short sides. The notch is shaped complementarily with a guide rail that guides the heat exchanger plates when they are stacked to form a plate heat exchanger. An assembled plate heat exchanger is therefore most unstable along the long sides, since they lack supporting guide rails.

Currently, to overcome this problem, the plate material outside the gasket groove of an individual heat exchanger plate is corrugated as shown in FIG. 3 of WO 93/01463 to give the plate edge relatively greater strength and flexural rigidity than plates formed with a plane protruding flange. This corrugation also gives greater stability when many heat exchanger plates are stacked and clamped together to form a plate heat exchanger.

The most common form of corrugation is to press the plate material into a trapezoidal shape so as to form a hive pattern when several plates are assembled to form a plate heat exchanger, but it is also known to use other forms of corrugation. Swedish Patent No. 165 960, incorporated herein by reference in its entirety, discloses a heat exchanger plate having a corrugation between the gasket groove and the edge of the heat exchanger plate, where the outer portion of the heat exchanger plate is shaped as a reinforcing band which is positioned at the underside of the pressed plate.

In spite of the advantages of such corrugation, it has been found that these types of heat exchanger plates continue to have some weaknesses. For example, the edges can collapse when subjected to extreme operating conditions. This causes the heat exchanger plates to tip over and the hive pattern to collapse, resulting in possible leakage of the exchange medium. This risk is particularly great if the heat exchanger plates are made of a thin plate material.

SUMMARY OF THE INVENTION

According to the present invention, a reinforcing band formed along the corrugated edge of a heat exchange plate overcomes the above-noted weaknesses. The reinforcing band prevents the corrugations from deforming under adverse conditions. The band is positioned in the central plane of the heat exchange plate, resulting in increased strength upward and downward with respect to the central plane.

The corrugations between the gasket groove and the reinforcing band outermost on the heat exchanger plate may advantageously be formed as regular elevations and depressions with respect to the reinforcing band. Preferably, the elevations and the depressions are trapezoidal or wave-shaped. This ensures that a hive pattern is formed between the gasket groove and the reinforcing band when several plates are stacked to form a plate heat exchanger. The walls of the hive pattern, however, are considerably stronger than in the known heat exchanger plates as they consist of closed boxes instead of open flaps.

In a preferred embodiment, the heat exchanger plate is shaped as a rectangular plate having two long sides and two short sides. A reinforcing band is provided at each of the long sides and extends over a substantial portion of the length of the side.

Additional features and advantages of the invention will be made apparent from the following detailed description of illustrative embodiments which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
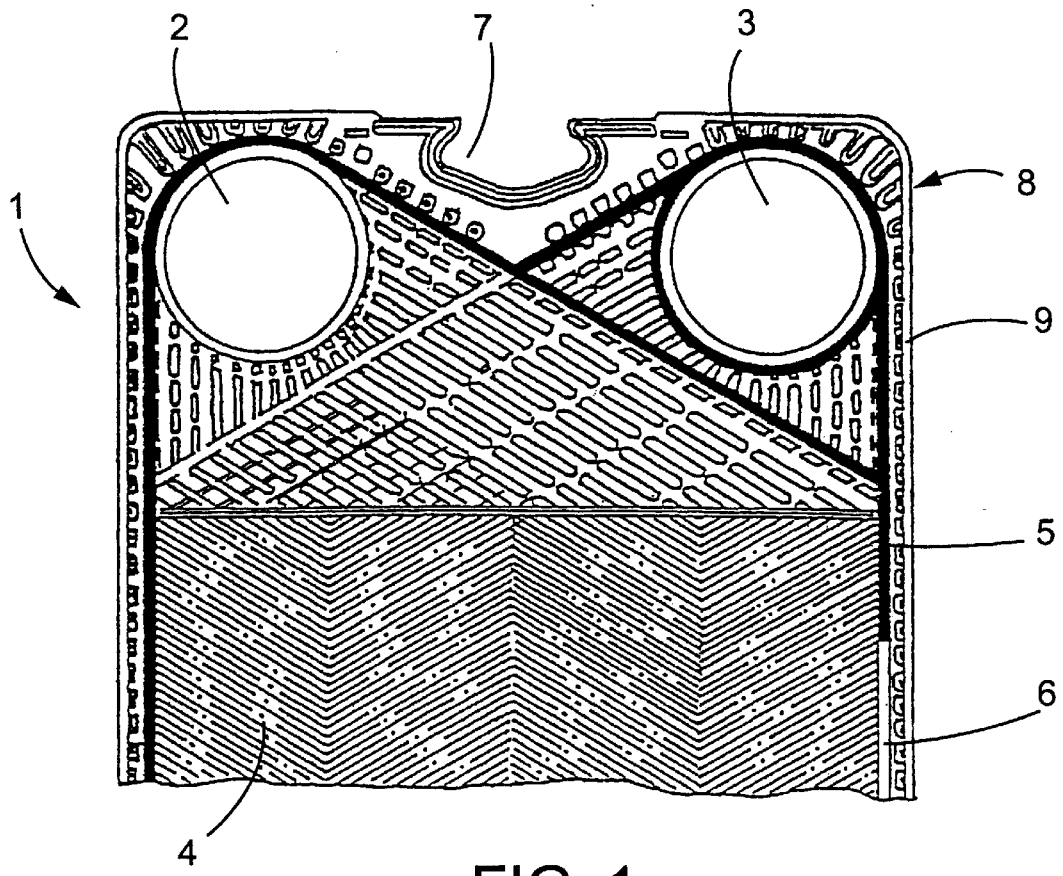
FIG. 1 is a partial view of a heat exchanger plate according to the present invention.

Turning to the drawings, wherein like reference numerals refer to like elements, FIG. 1 shows one end of a heat exchanger plate 1 according to the invention. The opposite end is shaped in the same manner, and the plate 1 thus constitutes a rectangular plate provided with four holes 2, 3 which serve as inlet and outlet ports for two heat exchanger media.

The center of the plate 1 comprises a flow area 4 which is defined by a gasket 5 which is positioned in a gasket groove 6. The gasket 5 extends out around the hole 2 and thus permits a first heat exchanger medium to flow from the hole 2 across the surface of the plate 1 and out of a corresponding hole at the opposite end of the plate 1. The hole 3 is blocked by the gasket 5, and the second heat exchanger medium is thus prevented from flowing on this side of the plate 1.

When a plurality of these plates 1 is assembled to form a plate heat exchanger as shown in FIG. 1 of WO 93/01463, every second plate is turned 180 degrees, so that the hole 2 and the hole 3 are alternately blocked by the gasket 5. Thus, one heat exchanger medium flows on one side of each plate 1, while the other heat exchanger medium flows on the other side. The short side of the plate 1 is formed with a notch 7 that is shaped complementarily with a guide rail (not shown) used when several plates are stacked to form a plate heat exchanger.

The plate 1 is corrugated over the entire surface to give it additional strength and rigidity and to create gaps between juxtaposed plates. The corrugations may have different shapes at different points on the plate 1 as shown, as they serve different functions. In a preferred embodiment, the plate material has essentially the same thickness as the starting material everywhere.

Figure 2:
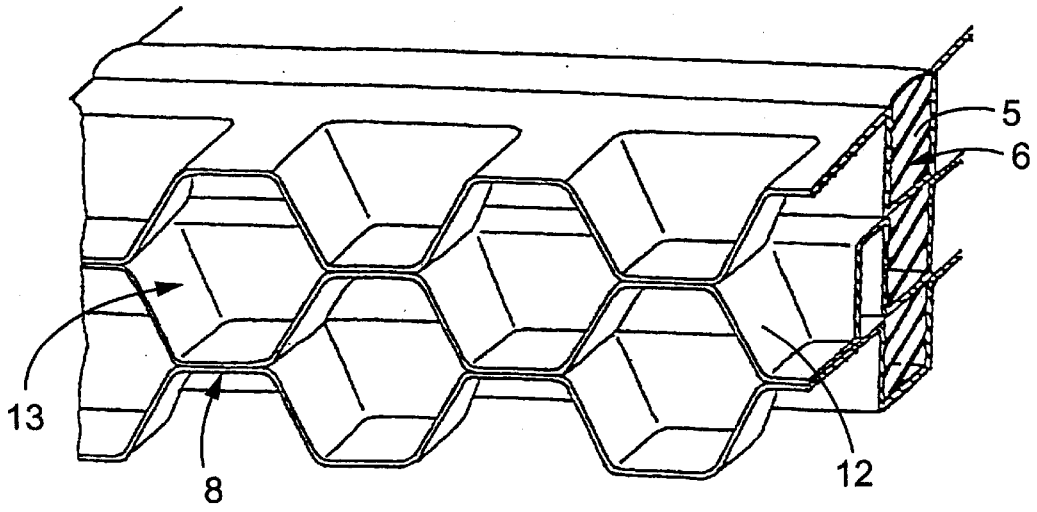
FIG. 2 (PRIOR ART)
FIG. 2 is an enlarged side view of a heat exchanger plate according to the prior art.

As shown in prior art FIG. 2, a conventional heat exchanger plate 1 is typically formed with trapezoidal corrugations 12 extending from the gasket groove 6 to the edge 8 of the plate, which, as shown, forms a hive pattern when several of these plates are stacked to form a plate heat exchanger. The corrugations give the plate 1 greater strength and rigidity in the area of the edge 8. This trapezium shape, however, is vulnerable to pressure loads perpendicular to the corrugations 12, and, extreme conditions of heat and pressure can deform the corrugations, causing the hive pattern to collapse. When this happens, there is a great risk that the plates will separate so that the gasket 5 can no longer maintain a good seal between the plates, causing the plate heat exchanger to leak.

Figure 3:
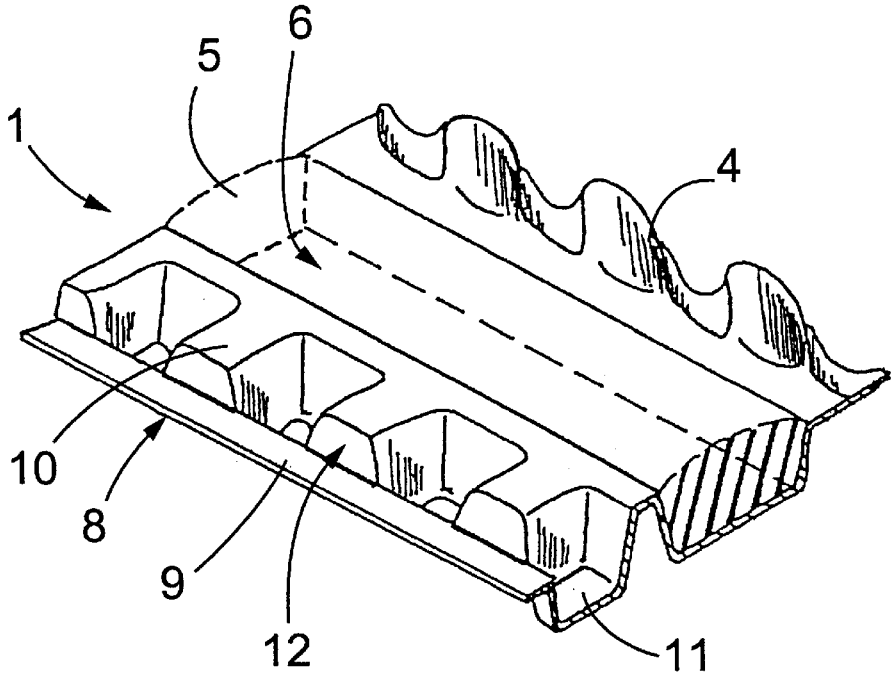
FIG. 3 is an enlarged perspective view of the edge of a heat exchanger plate according to the present invention.

As shown in FIG. 3, a heat exchanger plate 1 according to the present invention has a reinforcing band 9 formed at the outside of the corrugations 12. The corrugations 12 are located on the external side of the gasket groove 6 and consist of elevations 10 extending to the highest level of the plate 1 and depressions 11 extending to the lowest level of the plate 1. The reinforcing band 9 lies approximately within the central plane of the plate 1. When the outermost portion of the plate 1 is constructed in this manner, the reinforcing band 9 strengthens the edge 8 and thereby prevents the corrugations 12 from being deformed under extreme operating conditions.

Figure 4:
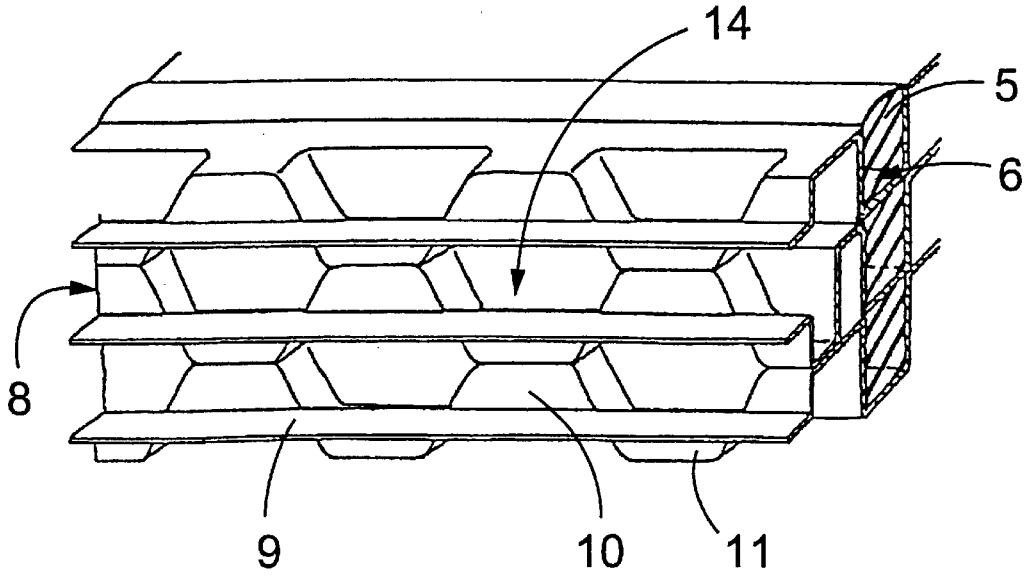
FIG. 4 is an enlarged side view of a heat exchanger plate according to the present invention.

When the heat exchanger plates according to the invention are stacked to form a plate heat exchanger, a considerably more stable structure is achieved. The hive pattern is maintained, but instead of consisting of open honeycombs 13 as shown in prior art FIG. 2, a plate heat exchanger built with a series of plates 1 according to the present invention consists of partially closed honeycombs 14 in the form of elevations 10 and depressions 11, as shown in FIG. 4. This creates a considerably stronger structure than a heat exchanger constructed with conventional plates. Moreover, the reinforcing band 9 ensures that the edge 8 cannot be stretched in the longitudinal direction, which imparts additional strength to the structure.

In the examples shown, the corrugations of the heat exchanger plates outside the gasket groove 6 are shown as being trapezoidal, but, as mentioned, these may also have other shapes, such as a wave shape. There may also be areas along the edge 8 where corrugations are not provided, if additional strength is not needed in these areas.

The reinforcing band 9 may be provided along the entire edge 8 of the heat exchanger plate 1, but it is also possible merely to provide a reinforcing band 9 along a portion of the edge 8, e.g. along the long sides of the heat exchanger plate 1 if the heat exchanger plate 1 is rectangular. Furthermore, one or more reinforcing bands 9 may be provided over a short extent of the edge 8 of the heat exchanger plate 1.

In view of the many possible embodiments to which the principals of this invention may be applied, it should be recognized that the embodiment described herein with respect to the drawing figures is meant to be illustrative only and should not be taken as limiting the scope of the invention. The illustrated embodiment can be modified in arrangement and detail without departing from the spirit of the invention. Therefore, the invention as described herein contemplates all such embodiments as may come within the scope of the following claims and equivalents thereof.

We claim:

1. A heat exchanger plate comprising: a plate having a perimeter; corrugations formed along a portion of the perimeter, wherein the corrugations are comprised of elevations and depressions, a side of the corrugation defining an edge; and a reinforcing band protruding from the edge, wherein the reinforcing band is disposed between the elevations and the depressions to provide structural support.

2. The heat exchanger plate of claim 1, wherein the corrugations are comprised of elevations extending to a highest level of the plate and depressions extending to a lowest level of the plate.

3. The heat exchanger plate of claim 1, wherein each of the corrugations is trapezoidally shaped.

4. The heat exchanger plate of claim 1, wherein each of the corrugations is wave shaped.

5. The heat exchanger plate of claim 1, wherein the reinforcing band lies approximately within the central plane of the plate.

6. The heat exchanger plate of claim 1, further comprising: a first annular rim formed in the plate defining an inlet; a second annular rim formed in the plate defining an outlet; and a flow area communicating with the inlet and the outlet.

7. The heat exchanger plate of claim 1 wherein the plate has a gasket groove and the heat exchanger plate further comprises a gasket sealingly fitted within the gasket groove, the corrugations being disposed between the gasket and the reinforcing band.

8. A plate heat exchanger comprising: a plurality of juxtaposed plates, wherein each plate has a perimeter, and each plate comprises corrugations formed along a portion of the perimeter, wherein the corrugations are comprised of elevations and depressions, a side of the corrugations defining an edge; and a reinforcing band protruding from the edge of each plate, wherein the reinforcing band is disposed between the elevations and the depressions to provide structural support.

9. The plate heat exchanger of claim 8, wherein the corrugations are comprised of elevations extending to a highest level of each plate and depressions extending to a lowest level of each plate.

10. The plate heat exchanger of claim 8, wherein each of the corrugations is trapezoidally shaped.

11. The plate heat exchanger of claim 8, wherein each of the corrugations is wave shaped.

12. The plate heat exchanger of claim 8, wherein the reinforcing band lies approximately within the central plane of each plate.

13. The plate heat exchanger of claim 8, wherein each plate further comprises: a first annular rim formed in the plate defining an inlet; a second annular rim formed in the plate defining an outlet; and a flow area communicating with the inlet and the outlet.

14. The plate heat exchanger of claim 8, wherein each plate has a gasket groove, and each plate further comprises gaskets sealingly fitted within the gasket grooves.

15. A heat exchanger plate comprising; a plate having a highest level, a lowest level, a perimeter, a central plane, and a gasket groove substantially parallel to the perimeter of the plate; a central portion having a channeled flow area; a gasket sealingly fitted within the gasket groove, wherein the gasket seals off the channeled flow area; corrugations formed along a portion of the perimeter, a side of the corrugations defining an edge, wherein the corrugations are comprised of elevations extending to the highest level and depressions extending to the lowest level; and a reinforcing band protruding from the edge, wherein the reinforcing band is disposed between the elevations and depressions and the corrugations are between the reinforcing band and the gasket.

* * * * *